US008567888B2

(12) United States Patent
Makita et al.

(10) Patent No.: US 8,567,888 B2
(45) Date of Patent: Oct. 29, 2013

(54) LIQUID EJECTING APPARATUS AND METHOD OF CONTROLLING THE SAME

(75) Inventors: Shushi Makita, Suwa (JP); Kinya Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

(21) Appl. No.: 13/402,734

(22) Filed: Feb. 22, 2012

(65) Prior Publication Data

US 2012/0212530 A1 Aug. 23, 2012

(30) Foreign Application Priority Data

Feb. 23, 2011 (JP) ..... 2011-036812

(51) Int. Cl.
*B41J 29/38* (2006.01)

(52) U.S. Cl.
USPC ..... 347/10; 347/11; 347/5

(58) Field of Classification Search
USPC ..... 347/5, 9, 10, 11, 15
See application file for complete search history.

(56) References Cited

U.S. PATENT DOCUMENTS 6,354,686 B1 3/2002 Tanaka et al.
6,450,603 B1 * 9/2002 Chang ..... 347/10
6,824,238 B2 * 11/2004 Chang ..... 347/10

FOREIGN PATENT DOCUMENTS

JP 2003-251807 A 9/2003

* cited by examiner

*Primary Examiner* — Lam S Nguyen
(74) *Attorney, Agent, or Firm* — Kilpatrick Townsend & Stockton LLP

(57) ABSTRACT

A piezoelectric element changes a pressure in a pressure chamber and ejects ink from nozzles. A driving signal generating section generates a driving signal that includes an ejection pulse PA and PB which eject ink to a piezoelectric element, and a first transition element between the ejection pulse PA and PB. A starting end and a terminal end of the ejection pulse PA are set to a reference electric potential VA, and a starting end and a terminal end of an ejection pulse PB are set to a reference electric potential VB. An electric potential difference between the reference electric potential VA and the lowest electric potential of the ejection pulse PA is smaller than an electric potential difference between the reference electric potential VB and a highest electric potential of the ejection pulse PB, and the reference electric potential VA is lower than the reference electric potential VB.

12 Claims, 12 Drawing Sheets

LIQUID EJECTING APPARATUS AND METHOD OF CONTROLLING THE SAME

This application claims priority to Japanese Patent Application No. 2011-036812, filed Feb. 23, 2011, the entirety of which is incorporated by reference herein.

BACKGROUND

1. Technical Field

The present invention relates to a technique of ejecting liquid such as ink.

2. Related Art

From the related art, a liquid ejecting technique is suggested which ejects liquid in a pressure chamber from nozzles by varying the pressure of liquid in the pressure chamber by a pressure generating element such as a piezoelectric element and a heating element. In an ink jet type liquid ejecting head (a recording head) to which the liquid ejecting technique is applied, ink in the pressure chamber is ejected from the nozzles by selectively supplying a plurality of ejection pulses placed for each period (a printing cycle) of a driving signal to the pressure generating element. For example, as shown in (A) in FIG. 15, JP-A-2003-251807 discloses a technique which adjusts an electric potential range of each ejection pulse DP to the driving signal COM in which a plurality of ejection pulses DP (DP1, DP2, and DP3) ejecting inks of different weights is placed in the printing cycle TP.

In a technique of JP-A-2003-251807, an ejection pulse DP1 and an ejection pulse DP3 become a predetermined electric potential Vm in a starting end and a terminal end, and an ejection pulse DP2 becomes a ground electric potential GND in the starting end and the terminal end are arranged in the printing cycle TP. The ejection pulse DP2 is situated between the ejection pulse DP1 and the ejection pulse DP3. Furthermore, a preparation wave form DP0 to be changed from the electric potential Vm to the ground electric potential GND is placed ahead of the ejection pulse DP1, and a return wave form DP4 to be changed from the ground electric potential GND to the electric potential Vm is placed behind the ejection pulse DP3. When supplying the ejection pulse DP2 to the piezoelectric element, as shown in (B) in FIG. 15, the preparation wave form DP0 and the return wave form DP4 are also selected. When supplying the ejection pulse DP1 or the ejection pulse DP3 to the piezoelectric element, the preparation wave form DP0 and the return wave form DP4 are not selected. According to the configuration as above, it is possible to reduce the highest electric potential (the highest electric potential of the ejection pulse DP2) of the driving signal.

However, in a configuration of JP-A-2003-251807 in which the preparation wave form DP0 placed at the beginning of the printing cycle TP and the return wave form DP4 placed at the end of the printing cycle TP are selected together with the ejection pulse DP2, there are various restrictions in the selection of the wave form of the ejection pulse DP2 and each ejection pulse. For example, since the ejection pulse DP2 is based on the ground electric potential GND, the wave form is restricted to a shape which compresses the liquid in the pressure chamber once and decompresses the liquid after the compression. Furthermore, as shown in (B) in FIG. 15, since the preparation wave form DP0 and the return wave form DP4 are connected to the ejection pulse DP2 when selecting the ejection pulse DP2, there is a restriction that it is difficult to select the ejection pulse DP1 between the ejection pulse DP2 and the preparation wave form DP0 and the ejection pulse DP3 between the ejection pulse DP2 and the return wave form DP4 together with the ejection pulse DP2 in one printing cycle TP.

SUMMARY

An advantage of some aspects of the invention is to adjust electric potential ranges of each ejection wave form while relaxing a restriction concerning the driving signal.

According to an aspect of the invention, there is provided a liquid ejecting apparatus that includes nozzles which eject liquid; a pressure chamber which communicates with the nozzle; a pressure generating element which changes the pressure of liquid in the pressure chamber and ejects the liquid from the nozzles; a driving signal generating unit that generates a driving signal including a first ejection wave form and a second ejection wave form which causes the liquid to be ejected to the pressure generating element, and a first transition element between the first ejection wave form and the second ejection wave form; and a driving unit which controls the supplying of the driving signal to the pressure generating element, wherein the first ejection wave form is set to a first reference electric potential at a starting end and a terminal end, and the second ejection wave form is set to a second reference electric potential at the starting end and the terminal end, an electric potential difference between the first reference electric potential and a lowest electric potential of the first ejection wave form is smaller than an electric potential difference between the second reference electric potential and a lowest electric potential of the second ejection wave form, the first reference electric potential is lower than the second reference electric potential, and the electric potential of the first transition element is changed from one of the first reference electric potential and the second reference electric potential to the other thereof. In the configuration mentioned above, the electric potential ranges of each of the first ejection wave form and the second ejection form are adjusted such that the first reference electric potential of the first ejection wave form is lower than the second reference electric potential of the second ejection wave form. Since the first transition element, in which the electric potential is changed from one of the first reference electric potential and the second reference electric potential to the other thereof, is placed between the first ejection wave form and the second ejection wave form, the restriction concerning the driving signal is relaxed compared to the technique of JP-A-2003-251807, whereby it is possible to increase a degree of freedom of a design in association with the wave form of the driving signal.

For example, it is possible to adopt a decompression element which causes liquid to be decompressed in the pressure chamber, a compression liquid which causes the liquid to be compressed in the pressure chamber after the decompression by the decompression element, and a decompression element which causes the liquid to be decompressed in the pressure chamber after the compression by the compression element as the first ejection wave form and the second ejection wave form. According to the configuration mentioned above, it is possible to eject liquid from the nozzles by desired ejection characteristics. Furthermore, it is possible to select both of the first ejection wave form and the second ejection wave form and supply the same to the pressure generating element. Thus, there is an advantage that the number of the ejection wave form required for ejecting the liquid of a weight of a predetermined number of type is reduced.

According to the aspect of the invention, the first reference electric potential and the second reference electric potential may be set such that the lowest electric potential of the first ejection wave form is equal to the lowest electric potential of the second ejection wave form. In the aspect mentioned above, since the lowest electric potential of the first ejection wave form is equal to the lowest electric potential of the second ejection wave form, even when a pressure variation amount in the pressure chamber of a case of changing the supplying electric potential to the pressure generating element by a predetermined amount is changed in response to the supplying electric potential, it is possible to make the ejection characteristics of liquid by the first ejection wave form closer to the ejection characteristics of liquid by the supplying of the second ejection wave form. Furthermore, according to the aspect, the lowest electric potential of the first ejection wave form and the lowest electric potential of the second ejection wave form may be set to a ground electric potential. In the aspect, it is possible to lower the highest electric potential of the driving signal. Furthermore, in a configuration in which, the lower the supplying electric potential to the piezoelectric element is, the greater the pressure variation amount of the pressure chamber in the case of changing the supplying electric potential to the pressure generating element by a predetermined amount is, there is an advantage that the ejection amount of liquid can be sufficiently ensured by setting the lowest electric potential of the first ejection wave form and the lowest electric potential of the second ejection wave form to the ground electric potential.

According to the aspect of the invention, the electric potential difference between the highest electric potential and the lowest electric potential of the first ejection wave form and the second ejection wave form in the driving signal is lower than the electric potential difference between the highest electric potential and the lowest electric potential of the first ejection wave form and the second ejection wave form when setting the first reference electric potential and the second reference electric potential to be equal to each other. According to the aspect mentioned above, there is an advantage that the amplitude (a voltage variation amount) of the driving signal is reduced, as compared to a case where the first reference electric potential and the second reference electric potential are set to be equal to each other.

According to a first aspect (for example, FIG. 6), the first ejection wave form is situated ahead of the second ejection wave form, the first transition element is a section in which the electric potential is changed from the first reference electric potential to the second reference electric potential, and the driving signal includes a second transition element that is placed behind the second ejection wave form and in which the electric potential is changed from the second reference electric potential to the first reference electric potential. In the aspect mentioned above, in spite of the configuration in which the first reference electric potential of the first ejection wave form is different from the second reference electric potential of the second ejection wave form, it is possible to set both of a starting end (a time point of the driving signal) of the first ejection wave form and a terminal end (a terminal point of the driving signal) of the second transition element to the first reference electric potential.

According to a second aspect (for example, FIG. 10) of the invention, the first ejection wave form may be situated ahead of the second ejection wave form, the first transition element may be a section in which the electric potential is changed from the first reference electric potential to the second reference electric potential, and the driving signal may include a second transition element which is placed ahead of the first ejection wave form and in which the electric potential is changed from the second reference electric potential to the first reference electric potential. In the aspect, in spite of the configuration in which the first reference electric potential of the first ejection wave form is different from the second reference electric potential of the second ejection wave form, it is possible to set both the starting end (the time point of the driving signal) of the second transition element and the terminal end (the terminal point of the driving signal) of the second ejection wave form to the second reference electric potential.

According to a third aspect (for example, FIG. 11) of the invention, the first ejection wave form is situated behind the second ejection wave form, the first transition element may be a section in which the electric potential is changed from the second reference electric potential to the first reference electric potential, and the driving signal may include a second transition element that is placed behind the first ejection wave form and in which the electric potential is changed from the first reference electric potential to the second reference electric potential. In the aspect mentioned above, in spite of the configuration in which the first reference electric potential of the first ejection wave form is different from the second reference electric potential of the second ejection wave form, it is possible to set both of the starting end (the time point of the driving signal) of the second ejection wave form and the terminal end (the terminal end of the driving signal) of the second transition element to the second reference electric potential.

In a fourth aspect (for example, FIG. 12) of the invention, the first ejection wave form is situated behind the second ejection wave form, the first transition element may be a section in which the electric potential is changed from the second reference electric potential to the first reference electric potential, and the driving signal may include a second transition element that is placed ahead of the second ejection wave form and in which the electric potential is changed from the first reference electric potential to the second reference electric potential. In the aspect mentioned above, in spite of the configuration in which the first reference electric potential of the first ejection wave form is different from the second reference electric potential of the second ejection wave form, it is possible to set both of the starting end (the time point of the driving signal) of the second transition element and the terminal end (the terminal end of the driving signal) of the first ejection wave form to the first reference electric potential.

In the respective preferable examples from the first aspect to the fourth aspect described above, the driving unit may minutely vibrate liquid surfaces in the nozzles so that liquid is not ejected from the nozzles by supplying the first transition element and the second transition element to the pressure generating element. In the aspect mentioned above, it is possible to eliminate the thickening of liquid present near the nozzles by minutely vibrating the liquid surfaces in the nozzles. Furthermore, since the minute vibration is applied to the liquid surfaces by supplying the first transition element and the second transition element to the pressure generating element, there is an advantage that the period of the driving signal is shortened (and the operation of the liquid ejecting apparatus is accelerated) as compared to the configuration in which an individual minute vibration wave form for applying the minute vibration to the liquid surfaces is included in the driving signal.

The invention is also specified as a method of controlling the liquid ejecting apparatus according to the respective aspects mentioned above. According to still another aspect of the invention, there is provided a method of controlling the liquid ejecting apparatus that includes nozzles ejecting liquid, a pressure chamber communicating with the nozzles, and a pressure generating element which changes the pressure in the pressure chamber and ejects the liquid from the nozzles, the method including generating a driving signal including a first ejection wave form and a second ejection wave form which causes the liquid to be ejected to the pressure generating element, and a first transition element between the first ejection wave form and the second ejection wave form; and controlling the supplying of the driving signal to the pressure generating element, wherein the first ejection wave form is set to a first reference electric potential at a starting end and a terminal end, and the second ejection wave form is set to a second reference electric potential at the starting end and the terminal end, an electric potential difference between the first reference electric potential and a lowest electric potential of the first ejection wave form is smaller than an electric potential difference between the second reference electric potential and a lowest electric potential of the second ejection wave form, the first reference electric potential is lower than the second reference electric potential, and the electric potential of the first transition element is changed from one of the first reference electric potential and the second reference electric potential to the other thereof. In the controlling method, the same action and effect as those of the liquid ejecting apparatus of the invention are also realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
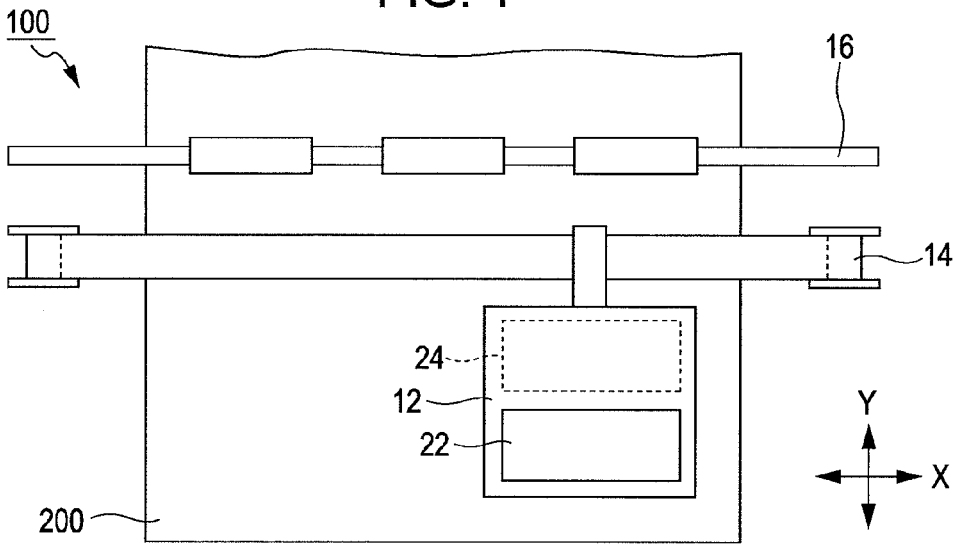
FIG. 1 is a partial configuration diagram of a printing apparatus according to a first embodiment of the invention.

FIG. 1 is a partial schematic diagram of an ink jet type printing apparatus 100 according to a first embodiment of the invention. The printing apparatus 100 is a liquid ejecting apparatus which ejects liquid droplets of ink to a recording paper 200, and includes a carriage 12, a movement mechanism 14, and a paper transport mechanism 16.

An ink cartridge 22 and a recording head 24 are mounted on the carriage 12. The ink cartridge 22 is a container that stores ink (liquid) to be ejected on to the recording paper 200. The recording head 24 functions as a liquid ejection head which ejects ink to be supplied from the ink cartridge 22 to the recording paper 200. In addition, it is also possible to adopt a configuration (an off-carriage method) in which the ink cartridge 22 is fixed to a case (not shown) of the printing apparatus 100 and ink is supplied to the recording head 24.

The movement mechanism 14 causes the carriage 12 to reciprocate in an X direction (a horizontal scanning direction). The position of the carriage 12 is detected by a detector (not shown) such as a linear encoder and is used for controlling the movement mechanism 14. The paper transport mechanism 16 transports the recording paper 200 in a Y direction (a vertical scanning direction) along with the reciprocation of the carriage 12. The recording head 24 ejects ink to the recording paper 200 when the carriage 12 reciprocates, whereby a desired image is recorded (printed) on the recording paper 200.

Figure 2:
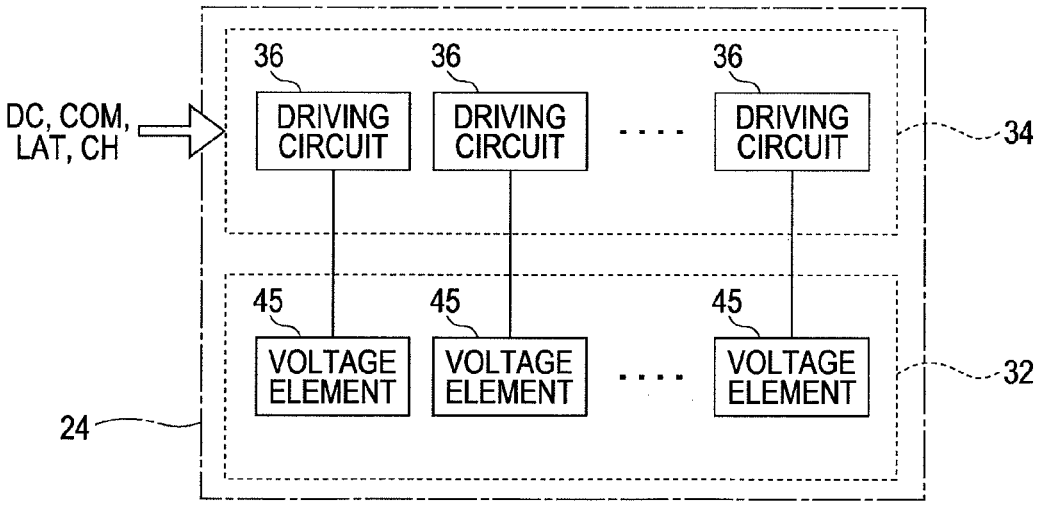
FIG. 2 is a block diagram of a recording head.

FIG. 2 is a block diagram of an electrical configuration of the recording head 24. As shown in FIG. 2, the recording head 24 includes an ejection section 32 and a driving section 34. The ejection section 32 ejects ink to the recording paper 200. The driving section 34 is a circuit that drives a piezoelectric element 45 of the ejection section 32, and is installed on the recording head 24, for example, in the form of an integrated circuit (an IC chip).

Figure 3A:
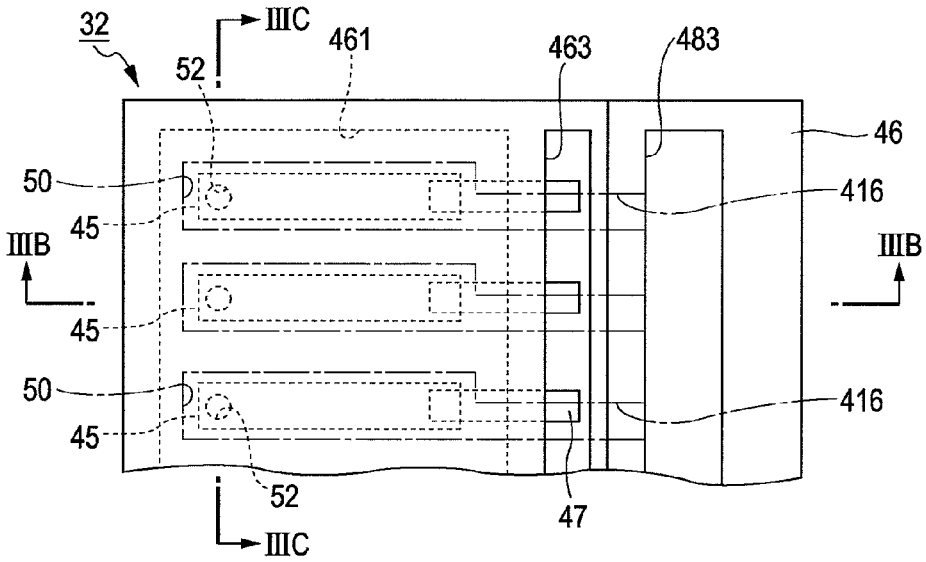
FIGS. 3A to 3C are configuration diagrams of an ejection section of the recording head.
Figure 3B:
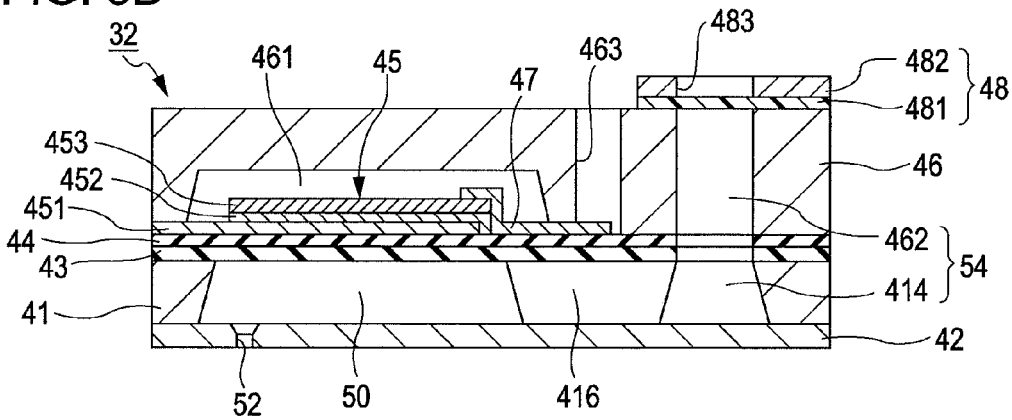
Figure 3C:
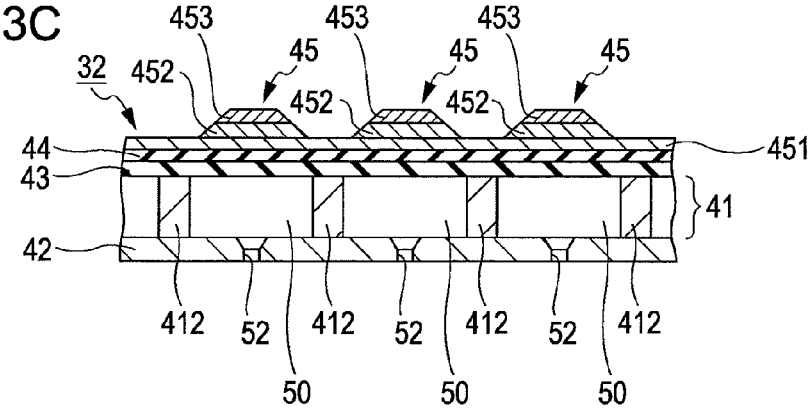

FIGS. 3A to 3C are configuration diagrams of the ejection section 32. Specifically, FIG. 3A is a plan view of the ejection section 32, FIG. 3B is a cross-sectional view of a line IIIB-IIIB in FIG. 3A, and FIG. 3C is a cross-sectional view of a line IIIC-IIIC in FIG. 3A. As shown in FIGS. 3A to 3C, schematically, the ejection section 32 has a structure in which a flow path forming substrate 41, a nozzle forming substrate 42, an elastic film 43 an insulating film 44, a piezoelectric element 45, and a protective substrate 46 are stacked.

The flow path forming substrate 41 is a plate material that is constituted by, for example, a metallic plate material such as stainless steel, a silicon single crystal substrate or the like. As shown in FIGS. 3A and 3C, in the flow path forming substrate 41, a plurality of elongated pressure chambers 50 are juxtaposed in a width direction (the Y direction), respectively. The pressure chambers 50 adjacent to each other are partitioned by a partition 412. Furthermore, in a region of the outside of a longer direction of each pressure chamber 50 of the flow path forming substrate 41, a communication section 414 is formed. The communication section 414 communicates with each pressure chamber 50 via an ink supplying path 416 formed for each pressure chamber 50. The ink supplying path 416 has a width narrower than that of the pressure chamber 50, and applies a constant flow path resistance to ink flowing from the communication 414 into the pressure chamber 50.

As shown in FIGS. 3B and 3C, the nozzle forming substrate 42 is fixed to the surface (an opening surface) of the flow path forming substrate 41, for example, through an adhesive, a thermal welding film or the like. The nozzle forming substrate 42 is formed with nozzles (through holes) 52 which communicate with an end portion of an opposite side of the ink supplying path 416 of the respective pressure chamber 50. A plurality of nozzles 52 is arranged in the Y direction. In addition, in fact, the nozzles 52 of multi-column are formed, but, only one column will be focused on in the first embodiment. On the surface of an opposite side of the nozzle forming substrate 42 of the flow path forming substrate 41, an elastic film 43 is formed by, for example, silicon oxide ($SiO_2$). On the surface of the elastic film 43, an insulating film 44 is formed by, for example, zirconium oxide ($ZrO_2$), and on the surface of the insulating film 44, the piezoelectric elements 45 are formed for each pressure chamber 50.

As shown in FIGS. 3B and 3C, the respective piezoelectric elements 45 is a structure in which a lower electrode 451, a piezoelectric material 452, and an upper electrode 453 are stacked from the insulating film 44 side in this sequence. One of the lower electrode 451 and the upper electrode 453 is a common electrode continued over the plurality of pressure chambers 50. The other of the lower electrode 451 and the upper electrode 453, and the piezoelectric material 452 are individually formed (patterned) for each pressure chamber 50. Setting which one of the lower electrode 451 and the upper electrode 453 to the common electrode is suitably determined in response to a polarization direction, circumstances of wiring, the piezoelectric material 452 or the like. However, in the first embodiment, a case is described as an example where the lower electrode 451 is the common electrode. The lower electrode 451 is supplied with a ground electric potential GND. A lead electrode 47 formed of, for example, gold (Au) or the like is connected to the upper electrode 453 of each piezoelectric element 45. When applying the electric filed between the lower electrode 451 and the upper electrode 453 by the supplying of the driving signal via the lead electrode 47, the respective piezoelectric elements 45 and the elastic film 43 are deformed (a flexural deformation).

As shown in FIG. 3B, the protective substrate 46 is fixed to a forming surface of each piezoelectric element 45 of the flow path forming substrate 41. In a region of the protective substrate 46 facing the respective piezoelectric elements 45, a piezoelectric element holding section 461 accommodating the respective piezoelectric elements 45 is formed. The piezoelectric element holding section 461 is molded to a size so as not to inhibit the displacement of the respective piezoelectric elements 45 and protects the respective piezoelectric elements 45. Furthermore, in a region of the protective substrate 46 corresponding to the communication section 414 of the flow path forming substrate 41, a reservoir section 462 penetrating through the protective substrate 46 is formed. The reservoir section 462 is an elongated space along a direction in which the respective pressure chambers 50 are arranged. A space, by which the communication section 414 of the flow path forming substrate 41 communicates with the reservoir section 462 of the protective substrate 46, constitutes a reservoir 54 that functions as a common ink chamber of the respective pressure chambers 50.

In a region of the protective substrate 46 between the piezoelectric element holding section 461 and the reservoir section 462, a through hole 463 penetrating through the protective substrate 46 in the thickness direction is formed. The lower electrode 451 and the lead electrode 47 of the piezoelectric element 45 are exposed to the inside of the through hole 463. Furthermore, a compliance substrate 48 with a sealing film 481 and a fixing plate 482 stacked thereon is bonded on the surface of the protective substrate 46. The sealing film 481 is formed of a material (for example, polyphenylene sulfide film) having low rigidity and flexibility and seals the reservoir section 462 of the protective substrate 46. The fixing plate 482 is formed of a hard material (for example, stainless steel) such as a metal and fixes the sealing film 481. In a region of the fixing plate 482 facing the reservoir 54 (the reservoir section 462), an opening section 483 is formed.

In the ejection section 32 having the configuration mentioned above, a space reaching from the reservoir 54 to the nozzles 52 via the respective ink supplying paths 416 and the respective pressure chambers 50 is filled with ink supplied from the ink cartridge 22. When the piezoelectric element 45 and the elastic film 43 are deformed by the supplying of the driving signal, pressure of ink in the pressure chamber 50 is varied. By controlling the pressure fluctuation of ink in the pressure chamber 50 in response to the driving signal, it is possible to execute an operation (hereinafter, referred to as an "ejection driving") of ejecting ink in the pressure chamber 50 from the nozzles 52, or an operation (hereinafter, referred to as a "minute vibration driving") of minutely vibrating a liquid surface (meniscus) of ink in the nozzles 52 so that ink in the pressure chamber 50 is not ejected.

Figure 4:
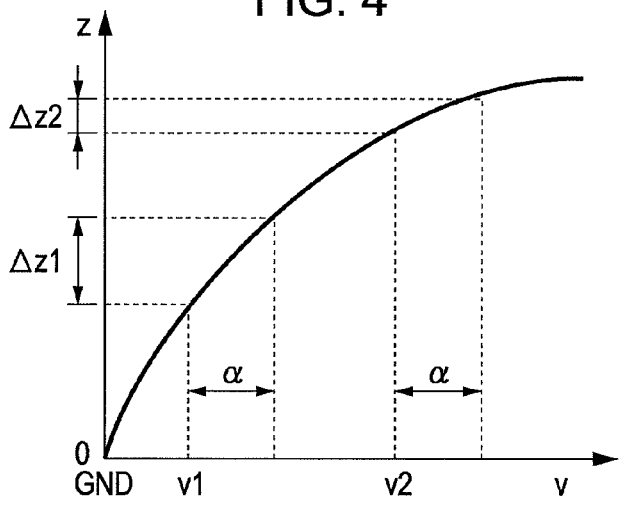
FIG. 4 is a graph that shows a relationship between a supplying electric potential to a piezoelectric element and a displacement of the piezoelectric element.

FIG. 4 is a graph that shows a relationship between a supplying electric potential (an application voltage of the piezoelectric element 45) to the piezoelectric element 45 (the upper electrode 453) and a displacement amount z of the piezoelectric element 45. The pressure of ink in the pressure chamber 50 and the weight of ink ejected from the nozzles 52 are substantially linearly changed in response to the displacement amount z of the piezoelectric element 45. Thus, it is possible to make a longitudinal axis of FIG. 4 identical to the pressure of ink in the pressure chamber 50 and the weight of ink ejected from the nozzles 52.

As shown in FIG. 4, as the supplying electric potential v to the piezoelectric element 45 rises, the displacement amount z of the piezoelectric element 45 is increased. Furthermore, as will be understood from FIG. 4, in the ejection section 32 of the configuration of FIG. 3, there is a tendency that the displacement amount (the pressure variation amount ink in the pressure chamber 50) of the piezoelectric element 45 is changed in response to the supplying electric potential v when changing the supplying electric potential v to the piezoelectric element 45 by a determined amount $\alpha$. For example, a displacement amount $\Delta z1$ when changing the supplying electric potential v from the electric potential v1 by a predetermined amount $\alpha$ is higher than a displacement amount $\Delta z2$ when changing the supplying electric potential v from the electric potential v2 exceeding the electric potential v1 by the same predetermined amount $\alpha$. Thus, from the viewpoint of sufficiently ensuring the ejection amount, a configuration is preferable in which a variation range of the supplying electric potential v to the piezoelectric element 45 is set to a lower position side (a range close to the ground electric potential GND).

Figure 5:
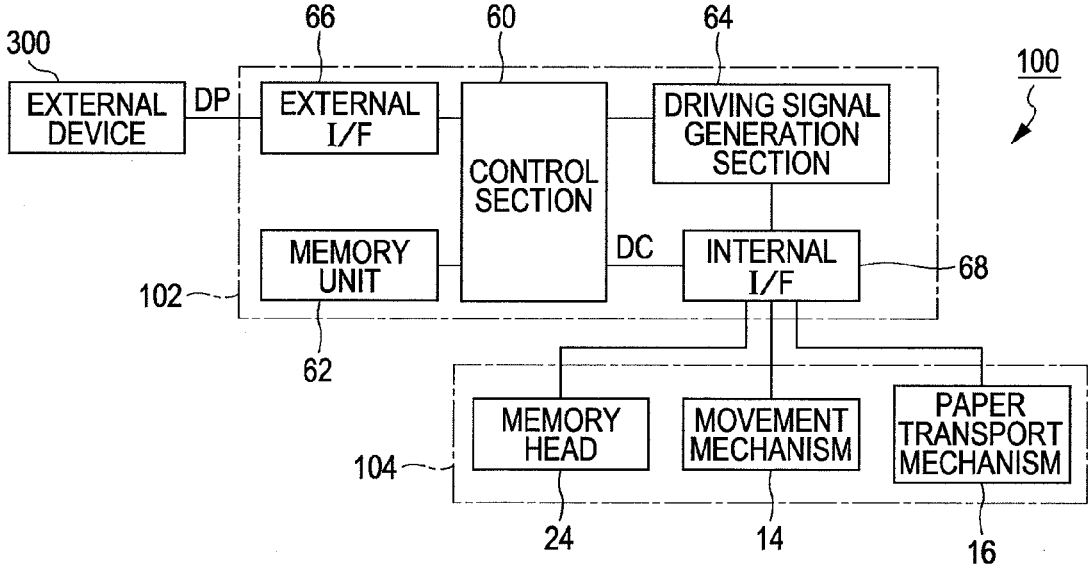
FIG. 5 is a block diagram of an electric configuration of the printing apparatus.

FIG. 5 is a block diagram of an electric configuration of the printing apparatus 100. As shown in FIG. 5, the printing apparatus 100 includes a control device 102, and a print processing section (a print engine) 104. The print processing section 104 is an element which records an image on the recording paper 200, and includes the recording head 24, the movement mechanism 14, and the paper transport mechanism 16 mentioned above. The control device 102 is an element controlling the print processing section 104, and includes a control section 60, a memory section 62, a driving signal generating section 64, an external I/F (interface) 66, and an internal I/F 68. Print data DP indicating an image printed on the recording paper 200 is supplied from the external device 300 (for example, a host computer) to the external I/F 66, and the print processing section 104 is connected to the internal I/F 68.

Figure 6:
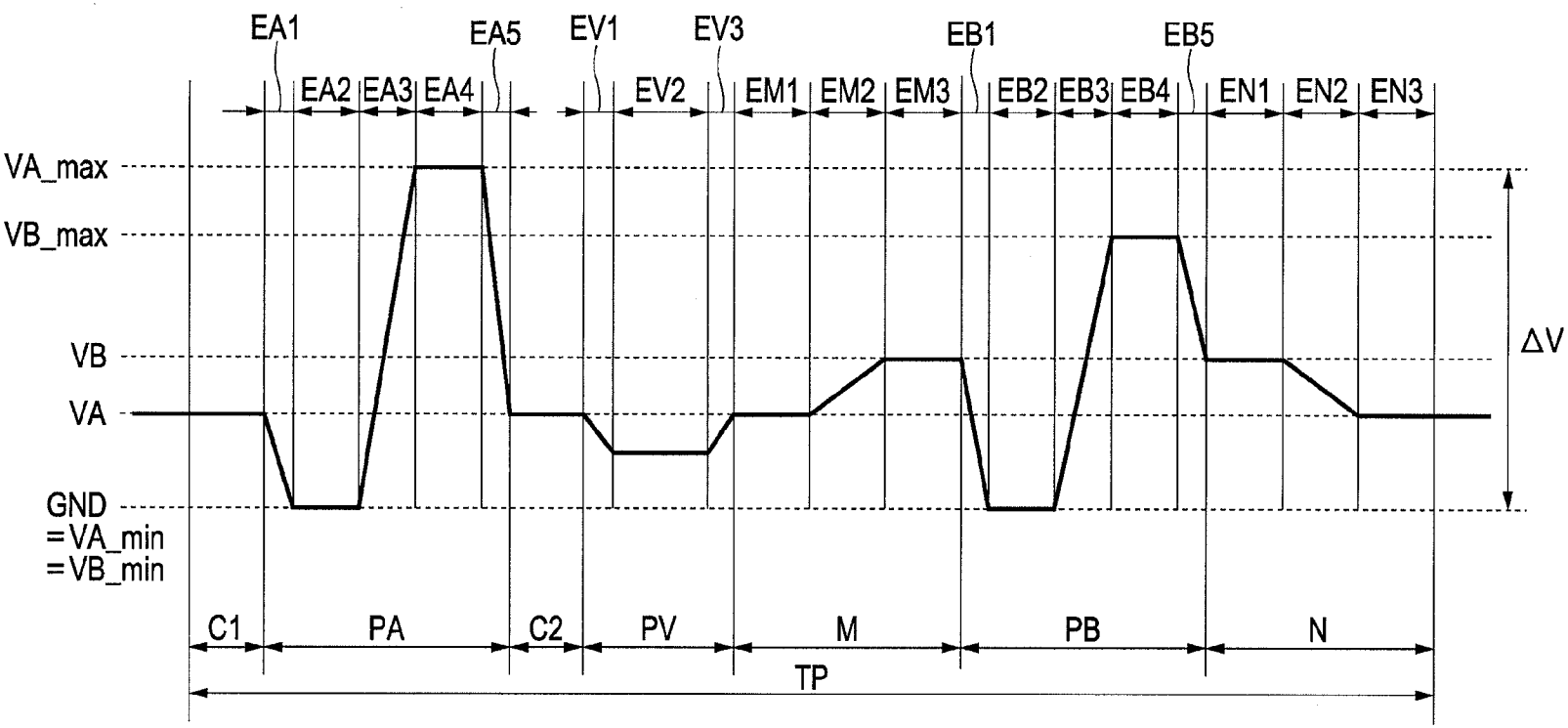
FIG. 6 is a wave form diagram of a driving signal.

The driving signal generating section 64 of FIG. 5 generates a driving signal COM of FIG. 6. The driving signal COM is a periodic signal used in the driving of the respective piezoelectric element 45. As shown in FIG. 6, in a time period (hereinafter, referred to as a "printing cycle") TP corresponding to one period of the driving signal COM, an ejection pulse PA, an ejection pulse PB, and a minute vibration pulse PV are placed. The ejection pulse PA is situated ahead of the ejection pulse PB, and the minute vibration pulse PV is situated between the ejection pulse PA and the ejection pulse PB. The ejection pulse PA is an example of the first ejection wave form of the invention, and the ejection pulse PB is an example of the second ejection wave form of the invention.

The ejection pulse PA and the ejection pulse PB are ejection wave forms that cause the piezoelectric element 45 to execute the ejection driving. Specifically, when the ejection pulse PA is supplied, the piezoelectric element 45 ejects ink of the weight corresponding to a middle dot from the nozzles 52 by changing the pressure of ink in the pressure chamber 50. Furthermore, when the ejection pulse PB is supplied, the piezoelectric element 45 ejects ink of the weight corresponding to a small dot from the nozzles 52 by changing the pressure of ink in the pressure chamber 50. Meanwhile, when the minute vibration pulse PA is supplied, the piezoelectric element 45 varies the pressure of ink in the pressure chamber 50 so that ink in the pressure chamber 50 is not ejected from the nozzles 52 and minutely vibrates (oscillates) the meniscus in the nozzles 52. The thickening of ink in the pressure chamber 50 is reduced by the agitation of the minute vibration driving.

As shown in FIG. 6, the ejection pulse PA is a wave form which is set to a reference electric potential VA at the starting end and the terminal end and in which a decompression element EA1, a maintenance element EA2, compression element EA3, a maintenance element EA4, and a decompression element EA5 are connected in that order. The decompression element EA1 is a section in which the electric potential is changed from the reference electric potential VA to an electric potential VA_min in a negative direction (a direction of decompressing ink in the pressure chamber 50). The maintenance element EA2 maintains the electric potential VA_min of the terminal end of the decompression element EA1. The compression element EA3 is a section in which the electric potential is changed from the electric potential VA_min of the terminal end (the terminal end of the decompression element EA1) of the maintenance element EA2 to an electric potential VA_max across the reference electric potential VA in a positive direction (a direction of compressing ink in the pressure chamber 50). The maintenance element EA4 maintains the electric potential VA_max of the terminal end of the compression element EA3. The decompression element EA5 is a section in which the electric potential is changed from the electric potential VA_max of the terminal end (the terminal end of the compression element EA3) of the maintenance element EA4 to the reference electric potential VA in the negative direction. That is, the electric potential of the ejection pulse PA is changed to the high position side and a low position side of the reference electric potential VA in the range from the highest electric potential VA_max to the lowest electric potential VA_min such that the pressure of ink in the pressure chamber 50 is controlled in the sequence of decompression→compression→decompression.

As shown in FIG. 6, the ejection pulse PB is a wave form which is set to a reference electric potential VB at the starting end and the terminal end and in which, like the ejection pulse PA, a decompression element EB1, a maintenance element EB2, a compression element EB3, and a maintenance element EB4, and a decompression element EB5 are connected in the sequence. In the decompression element EB1, the electric potential is changed from the reference electric potential VB to an electric potential VB_min in a negative direction. In the maintenance element EB2, the electric potential VB_min of the terminal end of the decompression element EB1 is maintained. In the compression element EB3, the electric potential is changed from the electric potential VB_min of the terminal end (the terminal end of the decompression element EB1) of the maintenance element EB2 to an electric potential VB_max across the reference electric potential VB in a positive direction. In the maintenance element EB4, the electric potential VB_max of the terminal end of the compression element EB3 is maintained. In the decompression element EB5, the electric potential is changed from the electric potential VB_max of the terminal end (the terminal end of the compression element EB3) of the maintenance element EB4 to the reference electric potential VB in the negative direction. That is, like the ejection pulse PA, the electric potential of the ejection pulse PB is changed to the high position side and a low position side of the reference electric potential VB in the range from the highest electric potential VB_max to the lowest electric potential VB_min, whereby the pressure of ink in the pressure chamber 50 is controlled in the sequence of decompression→compression→decompression.

As shown in FIG. 6, the reference electric potential VA of the ejection pulse PA and the reference electric potential VB of the ejection pulse PB are selected so that the lowest electric potential VA_min of the ejection pulse PA is equal to the lowest electric potential VB_min of the ejection pulse PB. In the first embodiment, both of the lowest electric potential VA_min and the lowest electric potential VB_min are set to the ground electric potential GND.

Figure 7:
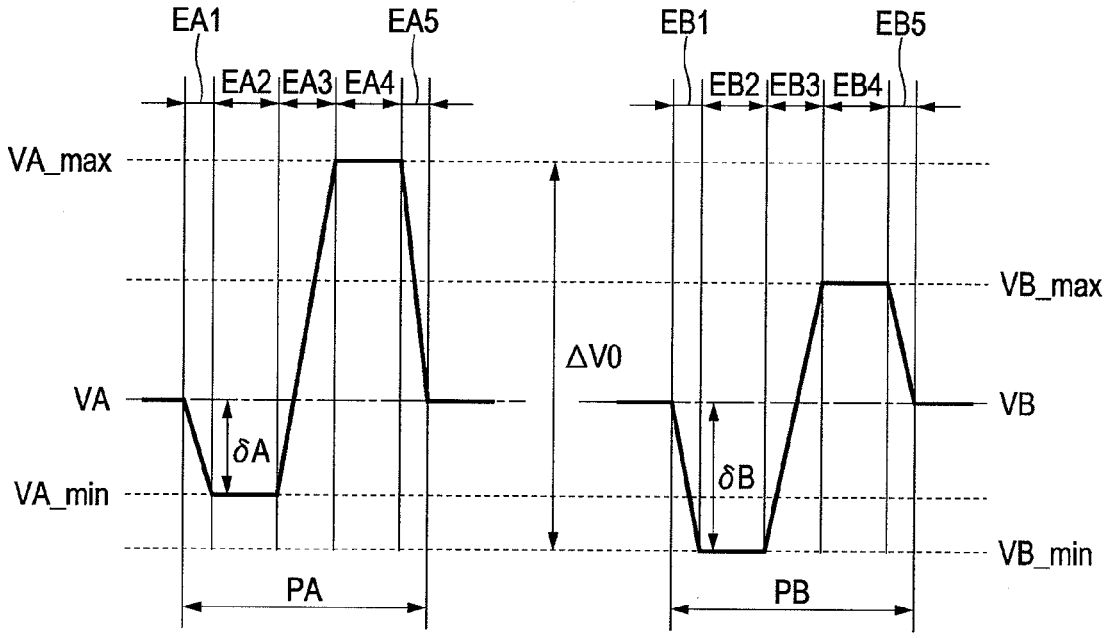
FIG. 7 is a schematic diagram that shows a relationship of each ejection pulse when matching a reference electric potential.

FIG. 7 shows an example of the ejection pulse PA and the ejection pulse PB when conveniently assuming that the reference electric potential VA is equal to the reference electric potential VB. As shown in FIG. 7, an electric potential difference (an electric potential variation amount of the lower position side to the electric potential VA) δA between the reference electric potential VA and the lowest electric potential VA_min in the ejection pulse PA is lower than an electric potential difference δB between the reference electric potential VB and the lowest electric potential VB_min in the ejection pulse PB. Thus, like FIG. 6, in the driving signal COM in which the lowest electric potential VA_min is matched with the lowest electric potential VB_min, the reference electric potential VA of the ejection pulse PA is lower than the reference electric potential VB of the ejection pulse PB. The electric potential difference between the reference electric potential VA and the reference electric potential VB corresponds to a difference (that is, an electric potential change amount when changing one electric potential of the ejection pulse PA and the ejection pulse PB to the other electric potential thereof from the state of FIG. 7 so as to match the lowest electric potential VA_min with the lowest electric potential VB_min) between the electric potential difference δA and the electric potential difference δB.

Symbol ΔV0 of FIG. 7 refers to an electric potential difference between the highest electric potential and the lowest electric potential of the ejection pulse PA and the ejection pulse PB when assuming that the reference electric potential VA is equal to the reference electric potential VB. In an example of FIG. 7, a difference between the highest electric potential VA_max of the ejection pulse PA and the lowest electric potential VB_min of the ejection pulse PB corresponds to the electric potential difference ΔV0 (ΔV0=VA_max−VB_min). As shown in FIG. 6, by matching the lowest electric potential VA_min of the ejection pulse PA with the lowest electric potential VB_min of the ejection pulse PB, the amount of electric potential variation (the difference between the highest electric potential and the lowest electric potential) ΔV in the driving signal COM is lower than the electric potential difference ΔV0 of the case of FIG. 7 assumed that the reference electric potential VA is equal to the ejection pulse VB (ΔV<ΔV0).

As shown in FIG. 6, the minute vibration pulse PV causing the piezoelectric element 45 to execute the minute vibration driving is a wave form in which a variation element EV1, a maintenance element EV2, and a variation element EV3 are connected in that order. In the variation element EV1, the electric potential is changed from the reference electric potential VA of the terminal end of the ejection pulse PA in the negative direction. The maintenance element EV2 maintains the electric potential of the terminal end of the variation element EV1. In the variation element EV3, the electric potential is changed from the electric potential of the terminal end of the maintenance element EV2 to the reference electric potential VA.

As shown in FIG. 6, a connection element C1 is connected to the starting end of the ejection pulse PA, and the ejection pulse PA and the minute vibration pulse PV are connected to each other by a connection element C2 between both of them. Each of the connection element C1 and the connection element C2 maintain the reference electric potential VA. Furthermore, the minute vibration pulse PV and the ejection pulse PB are connected to each other by a first transition element M, and a second transition element N is connected to the terminal end of the ejection pulse PB.

The first transition element M is an element which transits the electric potential from the reference electric potential VA of the ejection pulse PA situated ahead to the reference electric potential VB of the ejection pulse PB situated behind, and is formed in a wave form in which a maintenance element EM1, a vibration element EM2, and a maintenance element EM3 are connected in this order. The maintenance element EM1 maintains the reference electric potential VA of the terminal end (the terminal end of the ejection pulse PA) of the minute vibration pulse PV. In a variation element EM2, the electric potential is changed from the reference electric potential VA to the reference electric potential VB in the positive direction by a predetermined gradient. The gradient of the electric potential change in the variation element EM2 is selected such that the pressure variation of ink in the pressure chamber 50 is limited within a predetermined range (in a range in which ink in the pressure chamber 50 is not ejected) when supplying the variation element EM2 to the piezoelectric element 45. The maintenance element EM3 maintains the reference electric potential VB of the terminal end of the variation element EM2.

The second transition element N connected to the terminal end of the ejection pulse PB is an element which transits the electric potential from the reference electric potential VB of the ejection pulse PB to the reference electric potential VA, and is formed in the wave form in which a maintenance element EN1, a variation element EN2, and a maintenance element EN3 are connected in this order. The maintenance element EN1 maintains the reference electric potential VB of the terminal end of the ejection pulse PB, and the variation element EN2 changes the electric potential from the reference electric potential VB to the reference electric potential VA in the negative direction by a predetermined gradient. The gradient of the electric potential change in the variation element EN2 is selected such that the pressure variation of ink in the pressure chamber 50 is limited within a predetermined range (in a range in which ink in the pressure chamber 50 is not ejected) when supplying the variation element EN2 to the piezoelectric element 45. The maintenance element EN3 maintains the reference electric potential VA of the terminal end of the variation element EN2. As will be understood from the description mentioned above, the driving signal COM is set to the reference electric potential VA in both of the time point and the terminal point of the printing cycle TP.

The memory section 62 of FIG. 5 includes a ROM which stores a control program or the like, and a RAM which temporarily stores various data required for printing the image. The control section 60 generally controls the print processing section 104 through the execution of the control program stored in the memory section 62. Specifically, the control section 60 sequentially generates control data DC instructing the operation (ejection/non-ejection of ink) of each piezoelectric element 45 for each printing cycle TP in response to the print data DC.

The control data DC corresponding to one piezoelectric element 45 includes two bits, and designates any one of four types of gradation to be recorded on the recording paper 200. Specifically, the control data DC is set to any one of numerical value "11" designating a large dot, numerical value "10" designating a middle dot, numerical value "01" designating a small dot, and numerical value "00" designating a non-formation (non-ejection) of dot. The control data DC generated to each piezoelectric element 45 by the control section 60 is transmitted to the recording head 24 for each printing cycle TP.

Figure 8:
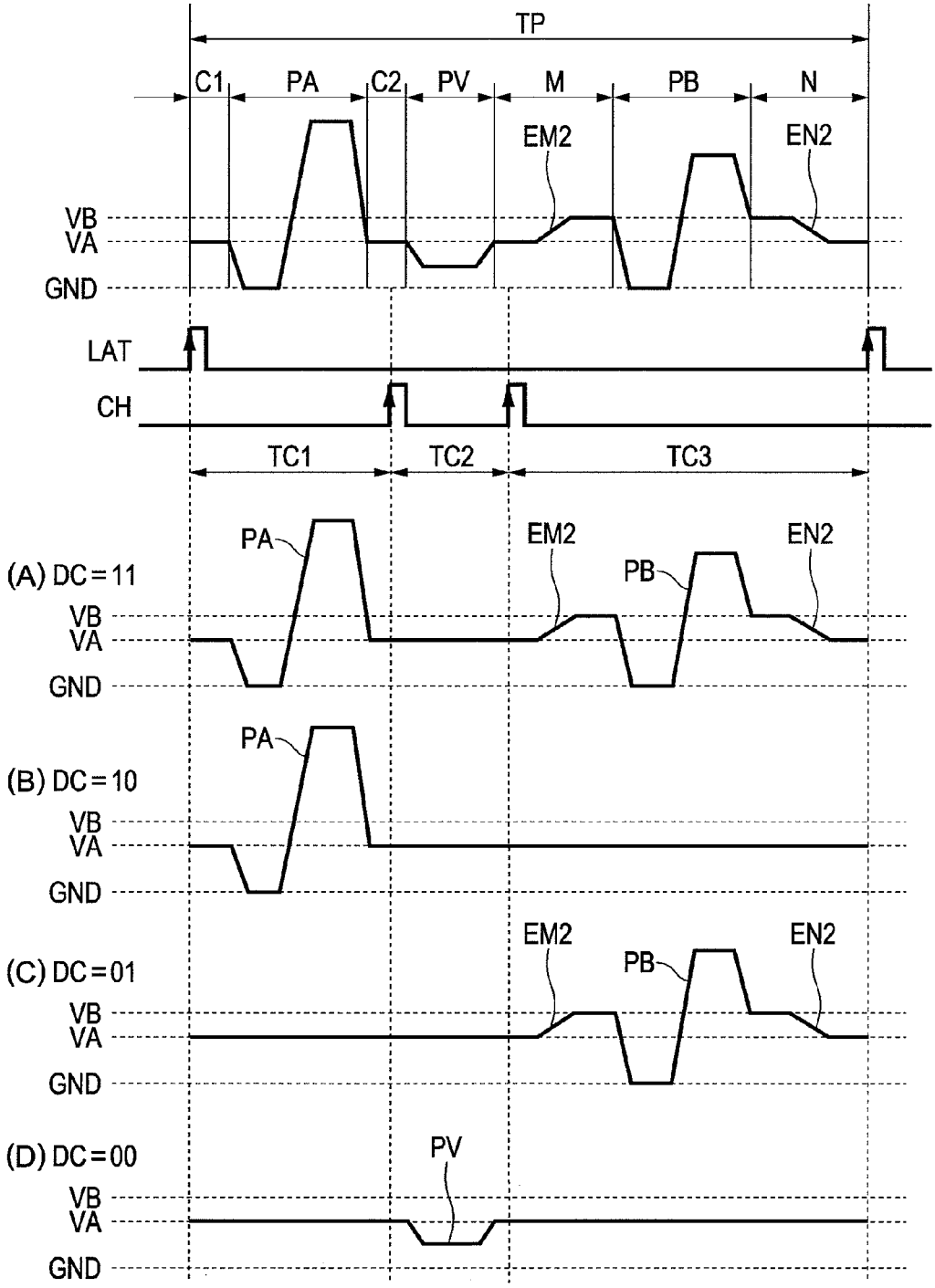
FIG. 8 is an explanatory diagram of an operation of a first embodiment.

As shown in FIG. 2, the driving section 34 of the recording head 24 includes a plurality (typically, the same number as that of the piezoelectric element 45) of driving circuits 36 corresponding to the different piezoelectric elements 45. The driving signal COM generated by the driving signal generating section 64 and the control data DC generated by the control section 60 are supplied to the respective driving circuit 36 via the internal I/F 68. Furthermore, the respective driving circuits 36 are supplied with a latch pulse LAT and a control pulse (a channel signal) CH from the control device 102. As shown in FIG. 8, the latch pulse LAT is generated at the time point of the respective printing cycles TP. As shown in FIG. 8, the respective printing cycles TP are divided into a plurality of control terms TC (TC1, TC2, and TC3). The control pulse CH is generated at the time point of the control term TC2 in each printing cycle TP and at the time point of the control term TC3. That is, the respective printing terms TC (TC1, TC2, and TC3) in the respective printing cycles TP are regulated by the latch pulse LAT and the control pulse CH.

As shown in FIG. 8, the control term TC1 is a term from the time point of the printing cycle TP to the middle time point in the connection element C2, the control term TC2 is a term from the terminal point of the control term TC1 to the middle time point in the maintenance element EM1 of the first transition element M, and the control term TC3 is a term from the terminal point of the control term TC2 to the terminal point of the printing cycle TP. Thus, the ejection pulse PA exists in the control period TC1, the minute vibration pulse PV exists in the control period TC2, and the ejection pulse PB, the variation element EM2 of the first transition element M, and the variation element EN2 of the second transition element N exist in the period term TC3.

The respective driving circuits 36 of the recording head 24 takes the control data DC corresponding to itself based on the latch pulse LAT generated at the time point of the printing cycle TP, and controls the supplying/blocking of the driving signal COM to the piezoelectric element 45 depending on the control data DC for each control term TC (TC1, TC2, and TC3). That is, the driving circuit 36 selects the section of the driving signal COM depending on the control data DC and supplies the same to the piezoelectric element 45.

Specifically, when the control data DC is a numerical value "11" indicating the large dot, as shown in (A) in FIG. 8, the driving circuit 36 supplies the piezoelectric element 45 with the driving signal COM at the control term TC1 and the control term TC3, and stops the supplying of the driving signal COM at the control term TC2. That is, both of the ejection pulse PA in the control term TC1 and the ejection pulse PB in the control term TC3 are supplied to the piezoelectric element 45, inks of the weight each corresponding to the middle dot and the small dot are sequentially ejected, and the large dot is formed.

Furthermore, when the control data DC is a numerical value "10" indicating the middle dot, as shown in (B) in FIG. 8, the driving circuit 36 causes the piezoelectric element 45 to execute the ejection driving of ink of the weight corresponding to the middle dot by supplying the piezoelectric element 45 with the driving signal COM at the control term TC1 including the ejection pulse PA. Similarly, when the control data DC is a numerical value "01" indicating the small dot, as shown in (C) in FIG. 8, the driving circuit 36 causes the piezoelectric element 45 to execute the ejection driving of ink of the weight corresponding to the middle dot by supplying the piezoelectric element 45 with the driving signal COM at the control term TC3 during which the ejection pulse PB exist. When the ejection pulse PB is selected (DC="11", and "01"), since the first transition element M (the variation element EM2) and the second transition element N (the variation element EN2) are supplied to the piezoelectric element 45 together with the ejection pulse PB, the electric potential supplied to the piezoelectric element 45 is continued before and after the time point and before and after the terminal point of the control term TC3.

Meanwhile, when the control data DC is a numerical value "00" indicating the non-ejection of ink, as shown in (D) in FIG. 8, the driving circuit 36 causes the piezoelectric element 45 to execute the minute vibration driving by supplying the piezoelectric element 45 with the driving signal COM at the control term TC2 including the minute vibration pulse PV. Thus, the liquid surface of ink in the nozzle 52 oscillates (minute vibration), and the thickening of ink is reduced.

As mentioned above, in the first embodiment, since the electric potential ranges of each of the ejection pulse PA and the ejection pulse PB are adjusted such that the reference electric potential VA of the ejection pulse PA is lower than the reference electric potential VB of the ejection pulse PB, as compared to a configuration (FIG. 7) in which the ejection pulse PA and the ejection pulse PB are placed so that the reference electric potential VA is equal to the reference electric potential VB, the electric potential variation amount $\Delta V$ in the driving signal COM is reduced. For this reason, there is an advantage that the electric power consumption in the driving signal generating section 64 and the driving circuit 36 is reduced, and an advantage that a pressure-resistant performance required for the driving signal generating section 64 and the driving circuit 36 is reduced.

Furthermore, since the first transition element M transited from the reference electric potential VA of the ejection pulse PA to the reference electric potential VB of the ejection pulse PB is interposed between the ejection pulse PA and the ejection pulse PB, there is an advantage that various restrictions concerning the driving signal COM is relaxed compared to the technique of JP-A-2003-251807. For example, the ejection pulse DP2 in the technique of JP-A-2003-251807 is limited to the wave form which changes the pressure of ink in the pressure chamber in the sequence of compression→decompression. However, in the first embodiment, as described above, it is possible to adopt the ejection pulse PA and the ejection pulse PB of the wave form which changes the pressure of ink in the pressure chamber 50 in the sequence of decompression→compression→decompression. Furthermore, in the technique of JP-A-2003-251807, since it is difficult to select the ejection pulse DP1 corresponding to the large dot and the ejection pulse DP3 corresponding to the middle dot together with the ejection pulse DP2 in one printing cycle TP, there is a required for three ejection pulses (DP1, DP2, and DP3) for each printing cycle TP so as to form three kinds of dots. Meanwhile, in the first embodiment as shown in (A) in FIG. 8, it is possible to select both of the ejection pulse PA and the ejection pulse PB in one printing cycle TP. Thus, it is possible to form three kinds of dots (the large dot, the middle dot, and the small dot) by a configuration in which two ejection pulses are placed for each printing cycle TP. Thus, there is an advantage that the printing cycle TP is shortened (and the operation of the printing apparatus 100 is accelerated) as compared to the technique of JP-A-2003-251807.

In addition, in the technique of JP-A-2003-251807, since the selection/the non-selection of the preparation wave form DP0 and the return wave form DP4 are controlled independently from the ejection pulses (DP1, DP2, and DP3), a plurality of control pulses CH is required for each printing cycle TP so as to regulate the control term (a term during which the selection/the non-selection of the driving signal are controlled) in the printing cycle TP. Meanwhile, in the first embodiment, the selection/the non-selection of the first transition element (the variation element EM2) and the second transition element N (the variation element EN2) control together with the ejection pulse PB. That is, there is no need to control the selection/the non-selection of the first transition element M and the selection/the non-selection of the second transition element N independently from the ejection pulse PB. Thus, there is also an advantage that it is possible to reduce the total number of the control pulse CH in the printing cycle TP compared to that of JP-A-2003-251807.

However, in the first embodiment, as described with reference to FIG. 4, the displacement amount (the pressure variation amount of ink in the pressure chamber 50) of the piezoelectric element 45 when changing the supplying electric potential v to the piezoelectric element 45 by a predetermined amount $\alpha$ is changed in response to the supplying electric potential v. Thus, when the lowest electric potential VA_min of the ejection pulse PA is different from the lowest electric potential VB_min of the ejection pulse PB, upon selecting the ejection pulse PA and the ejection pulse PB, there is a need to individually consider the ejection characteristics (the ejection amount and the flying speed) of the case of supplying the piezoelectric element 45 with the ejection pulse PA and the ejection characteristics of the case of supplying the piezoelectric element 45 with the ejection pulse PB. Meanwhile, in the first embodiment, the lowest electric potential VA_min of the ejection pulse PA and the lowest electric potential VB_min of the ejection pulse PB are set to the same electric potential. That is, the time point (the end point of the variation range) of the variation range of the supplying electric potential v to the piezoelectric element 45 is common to the ejection pulse PA and the ejection pulse PB, and the variation range of the supplying electric potential v by the ejection pulse PA and the variation range of the supplying electric potential v by the ejection pulse PB overlap with each other over a wide range. Thus, there is an advantage that it is possible to design the ejection pulse PA and the ejection pulse PB (the designs of the ejection pulse PA and the ejection pulse PB are facilitated) without considering the influence in which the variation amount z varies depending on the supplying electric potential v.

In addition, as mentioned above with reference to FIG. 4, there is a tendency that, as the supplying electric potential v to the piezoelectric element 45 is low, the displacement amount of the piezoelectric element 45 when changing the supplying electric potential v by a predetermined amount α is increased. Under such a tendency, in the first embodiment, the lowest electric potential VA_min of the ejection pulse PA and the lowest electric potential VB_min of the ejection pulse PB are set to the ground electric potential GND. Thus, there is an advantage that it is possible to sufficiently ensure the ejection amount of ink when supplying the ejection pulse PA or the ejection pulse PB.

Furthermore, in the first embodiment, in addition to the first transition element M that transits the reference electric potential VA of the ejection pulse PA to the reference electric potential VB of the ejection pulse PB, the second transition element N, which transits the reference electric potential VB to the reference electric potential VA, is placed behind the ejection pulse PB. Thus, the electric potential at the time point and the electric potential of the terminal point of the printing cycle TP of the driving signal COM are set to the same electric potential (the reference electric potential VA). That is, in spite of the configuration in which the reference electric potential VA of the ejection pulse PA is different from the reference electric potential VB of the ejection pulse PB, it is possible to continuously form the electric potential of the driving signal COM in the boundary of each printing cycle TP existing one after another.

B: Second Embodiment

A second embodiment of the invention will be described below. In addition, in each configuration described below, elements having the same action and function as those of the first embodiment are denoted by the same reference numerals mentioned above, and the respective detailed descriptions thereof will suitably be omitted.

FIGS. 9A to 9D are concept diagrams of an operation of the second embodiment. As shown in FIGS. 9A to 9D, the driving signal COM of the second embodiment is a wave form in which the minute vibration pulse PV and the connection element C2 in the first embodiment are omitted. That is, the first transition element M is an element that connects the terminal end of the ejection pulse PA with the starting end of the ejection pulse PB, and like the first embodiment, includes a maintenance element EM1, a variation element EM2, and a maintenance element EM3.

As shown in FIGS. 9A to 9D, a latch pulse LAT and a control pulse CH of the second embodiment regulates four control terms TC (TC1, TC2, TC3, and TC4) divided the printing cycle TP. The control term TC1 includes the ejection pulse PA like the first embodiment. Furthermore, the control term TC2 includes the variation element EM2 of the first transition element M, the control term TC3 includes the ejection pulse PB, and the control term TC4 includes the variation element EN2 of the second transition element N.

Figure 9:
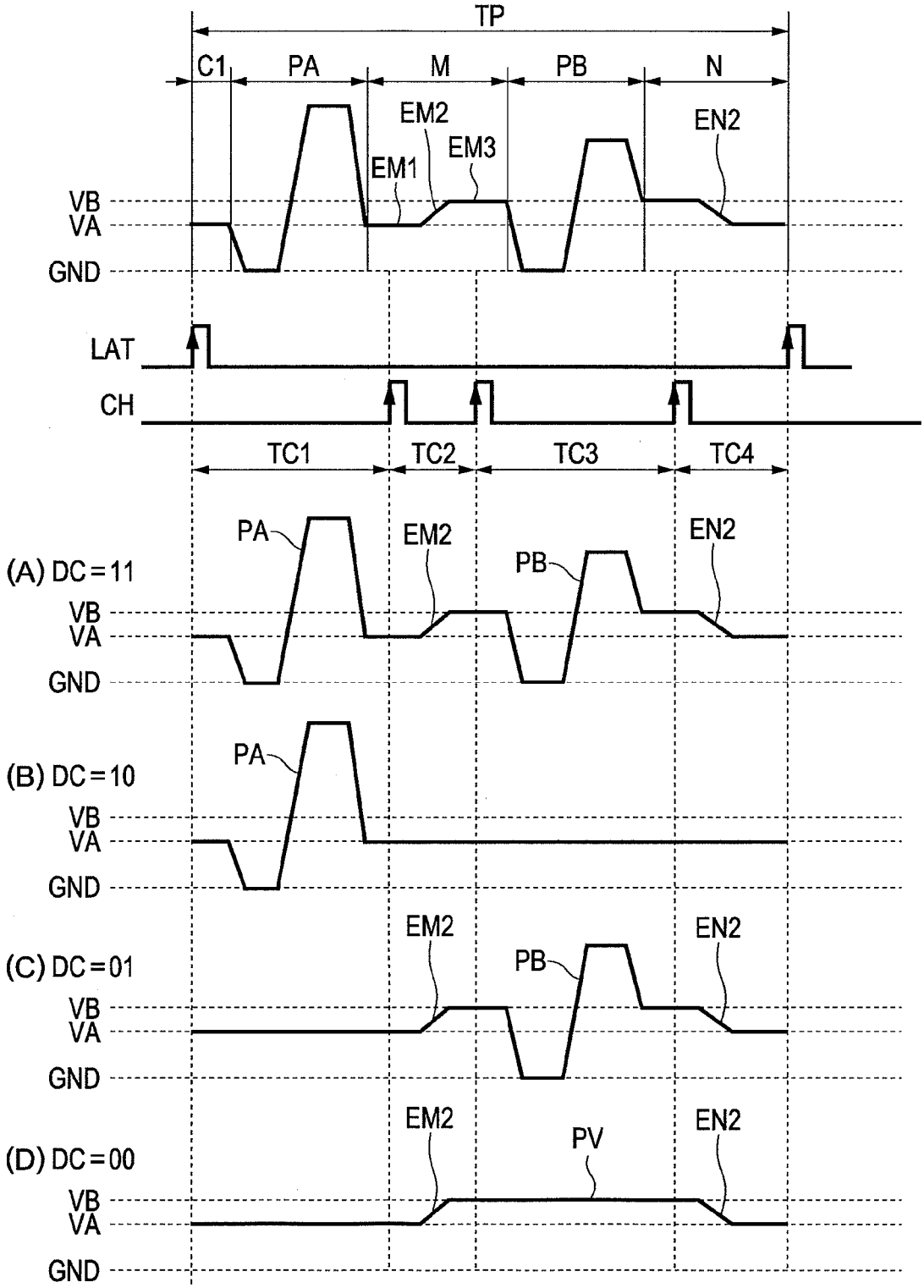
FIG. 9 is an explanatory diagram of an operation of a second embodiment.

When the control data DC is a numerical value "11" indicating the large dot, as shown in (A) in FIG. 9, the driving circuit 36 supplies the piezoelectric element 45 with the driving signal COM at the entire (TC1, TC2, TC3, and TC4) printing cycles TP. Thus, like the first embodiment, the piezoelectric element 45 is supplied with the ejection pulse PA and the ejection pulse PB and the large dot is formed.

When the control data DC is a numerical value "10" indicating the middle dot, as shown in (B) in FIG. 9, the driving circuit 36 supplies the piezoelectric element 45 with the driving signal COM at the control term TC1. Thus, the ejection pulse PA corresponding to the middle dot is supplied to the piezoelectric pulse 45. Furthermore, when the control data DC is a numerical value "01" indicating the small dot, as shown in (C) in FIG. 9, the driving circuit 36 supplies the piezoelectric element 45 with the driving signal COM at the control term TC2, the control term TC3, and the control term TC4. Thus, the ejection pulse PB corresponding to the small dot is supplied to the piezoelectric element 45. When the ejection pulse PB is selected, the variation element EM2 in the control term TC2 and the variation element EN2 in the control period TC4 are also supplied to the piezoelectric element 45. Thus, like the first embodiment, the electric potential supplied to the piezoelectric element 45 is continued before and after the control term TC3.

Meanwhile, when the control data DC is a numerical value "00" indicating the non-ejection, as shown in (D) in FIG. 9, the driving circuit 36 supplies the piezoelectric element 45 with the driving signal COM at the control term TC2 and the control term TC4, and stops the supplying of the driving signal COM at the control term TC1 and the control term TC3. Thus, the piezoelectric element 52 is supplied with the variation element EM2 of the first transition element M and the variation element EN2 of the second transition element N. Since the piezoelectric element 52 functions as a capacitor, the voltage applied at the previous control term TC2 is held at the control term TC3. That is, as shown in (D) in FIG. 9, the piezoelectric element 52 is supplied with a trapezoidal minute vibration pulse PV having both ends in the variation element EM2 and the variation element EN2, and the minute vibration driving is executed.

In the second embodiment, the same effect as that of the first embodiment is also realized. Furthermore, in the first embodiment, since the vibration element EM2 of the first transition element M and the vibration element EN2 of the second transition element N are used as the minute vibration pulse PV, the individual minute vibration pulse PV dedicated to the minute vibration driving is omitted from the driving signal COM. Thus, there is an advantage that, compared to the first embodiment in which the driving signal COM includes the individual minute vibration pulse PV, the printing cycle TP is shortened (and the operation of the printing apparatus 100 is accelerated).

C: Third Embodiment

In the first embodiment, the driving signal COM was set to the reference electric potential VA in the time point and the terminal point of the printing cycle TP. In the third embodiment, the first transition element M and the second transition element N are set such that the driving signal COM becomes the reference electric potential VB in the time point and the terminal point of the printing cycle TP.

Figure 10:
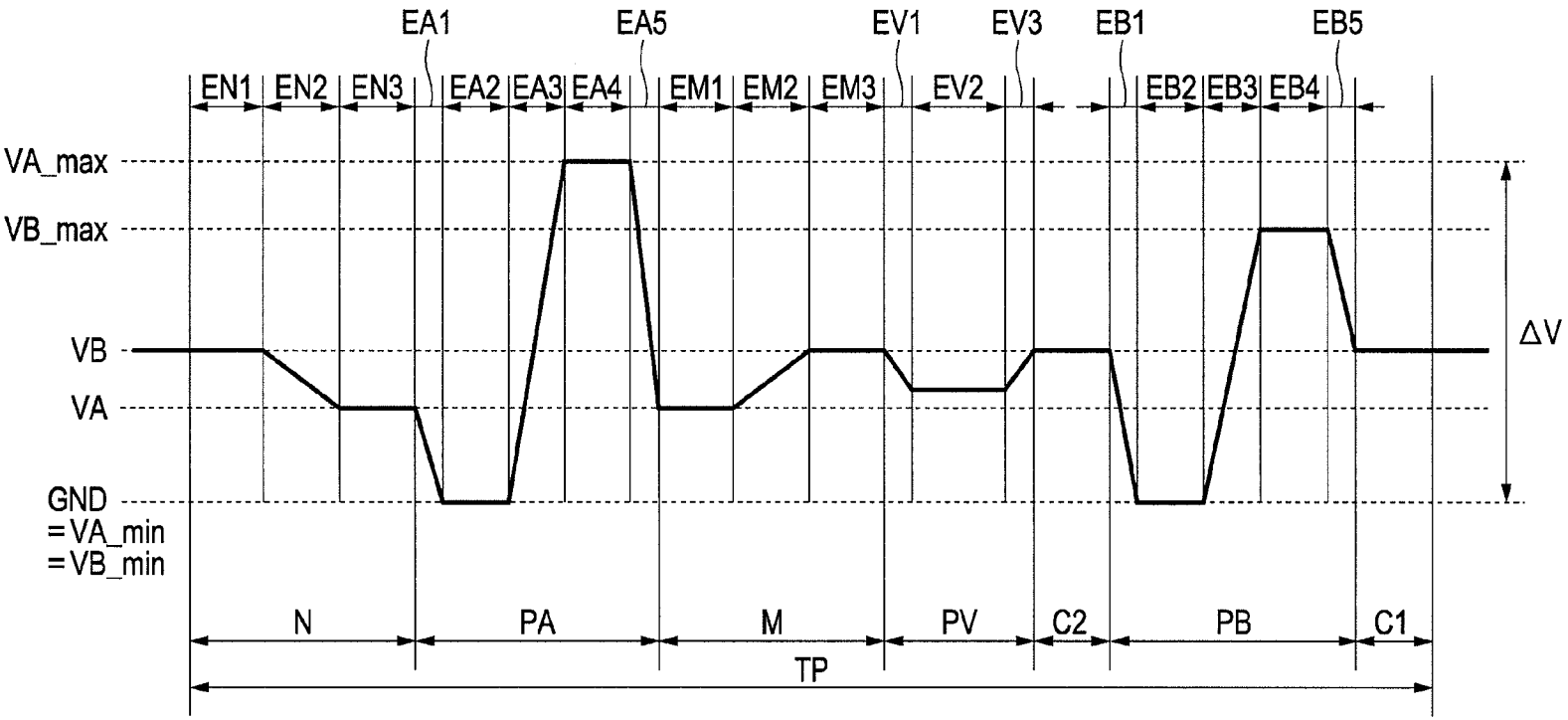
FIG. 10 is a wave form diagram of the driving signal in a third embodiment.

FIG. 10 is a wave form diagram of the driving signal COM of a third embodiment. As shown in FIG. 10, the first transition element M is placed immediately after (between the ejection pulse PA and the minute vibration pulse PV) the ejection pulse PA, and the second transition element N is placed immediately before the ejection pulse PA. Like the first embodiment, the first transition element M (the variation element EM2) is an element in which the electric potential is changed from the reference electric potential VA to the reference electric potential VB. The second transition element N (the variation element EN2) is an element in which the electric potential is changed from the reference electric potential VB to the reference electric potential VA. When the ejection pulse PA is selected (DC="11", and "10"), the piezoelectric element 45 is supplied with the variation element EM2 of the first transition element M and the variation element EN2 of the second transition element N together with the ejection pulse PA.

A connection element C2 is placed immediately before (between the minute vibration pulse PV and the ejection pulse PB) the ejection pulse PB, and a connection element C1 is placed immediately after the ejection pulse PB. Each of the connection element C1 and the connection element C2 maintains the reference electric potential VB. As described above, the driving signal COM is set to the reference electric potential VB in the time point (the starting end of the second transition element N) and the terminal point (the terminal end of the connection element C1) of the printing cycle TP. In the third embodiment, the same effect as that of the first embodiment is also realized.

D: Fourth Embodiment

In the first embodiment, the ejection pulse PA corresponding to the reference electric potential VA was placed ahead of the ejection pulse PB corresponding to the reference electric potential VA. A fourth embodiment is a form in which portions before and after the ejection pulse PA and the ejection pulse PB are reversed from those of the first embodiment.

Figure 11:
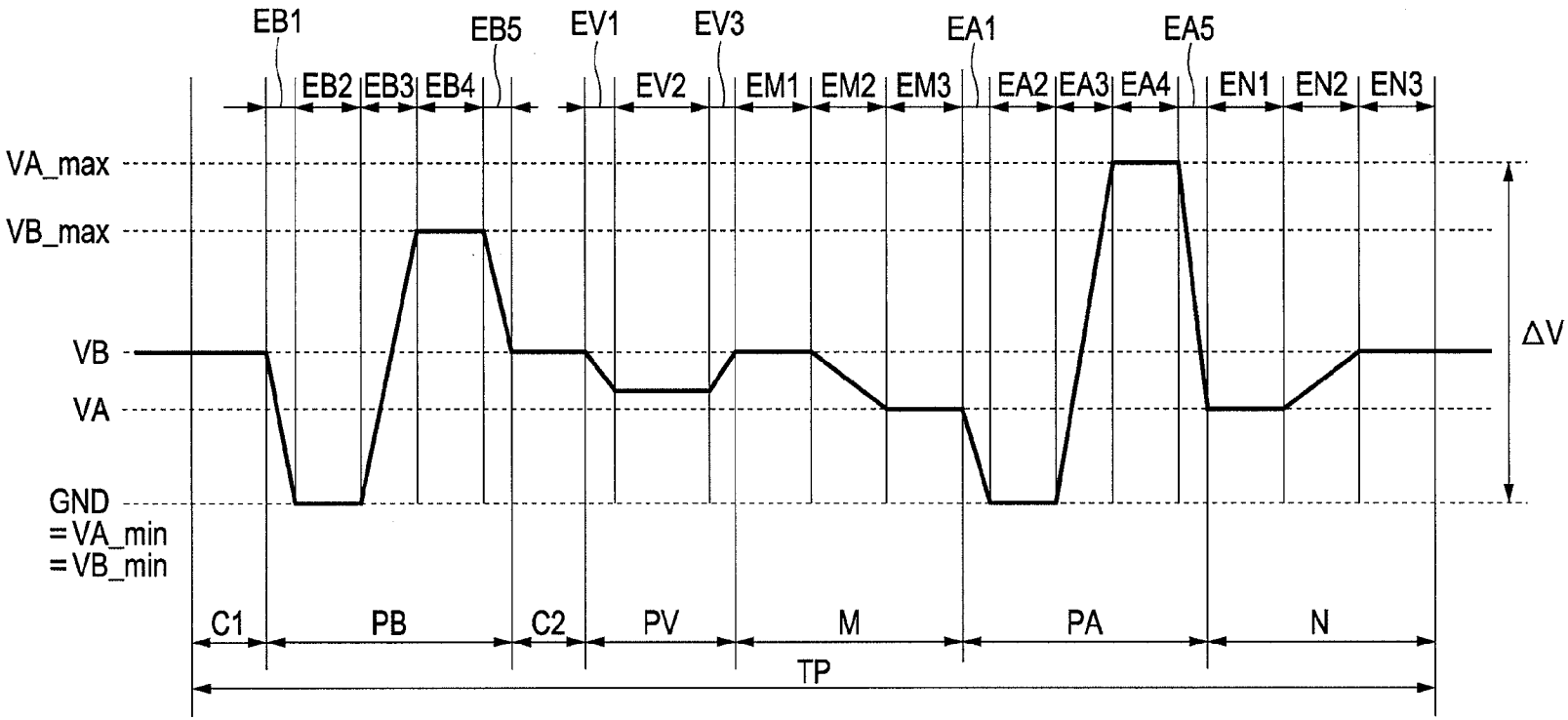
FIG. 11 is a wave form diagram of the driving signal in a fourth embodiment.

FIG. 11 is a wave form diagram of the driving signal COM of the fourth embodiment. As shown in FIG. 11, the ejection pulse PA corresponding to the reference electric potential VA is placed behind the ejection pulse PB corresponding to the reference electric potential VB. The front connection element C1 and the rear connection element C2 of the ejection pulse PB maintain the reference electric potential VB, and the starting end and the terminal end of the minute vibration pulse PV are set to the reference electric potential VB.

The first transition element M (the variation element EM2) situated ahead of the ejection pulse PA is an element in which the electric potential is changed from the reference electric potential VB to the reference electric potential VA in the negative direction, and the second transition element N (the variation element EN2) situated behind the ejection pulse PA is an element in which the electric potential is changed from the reference electric potential VA to the reference electric potential VB in the positive direction. As mentioned above, the driving signal COM is set to the reference electric potential VB at both of the time point (the starting end of the connection element C1) and the terminal point (the terminal end of the second transition element N) of the printing cycle TP. When the ejection pulse PA is selected (DC="11", and "10"), the piezoelectric element 45 is supplied with the variation element EM2 of the first transition element M and the variation element EN2 of the second transition element N together with the ejection pulse PA. In the fourth embodiment, the same effect as that of the first embodiment is also realized.

Figure 12:
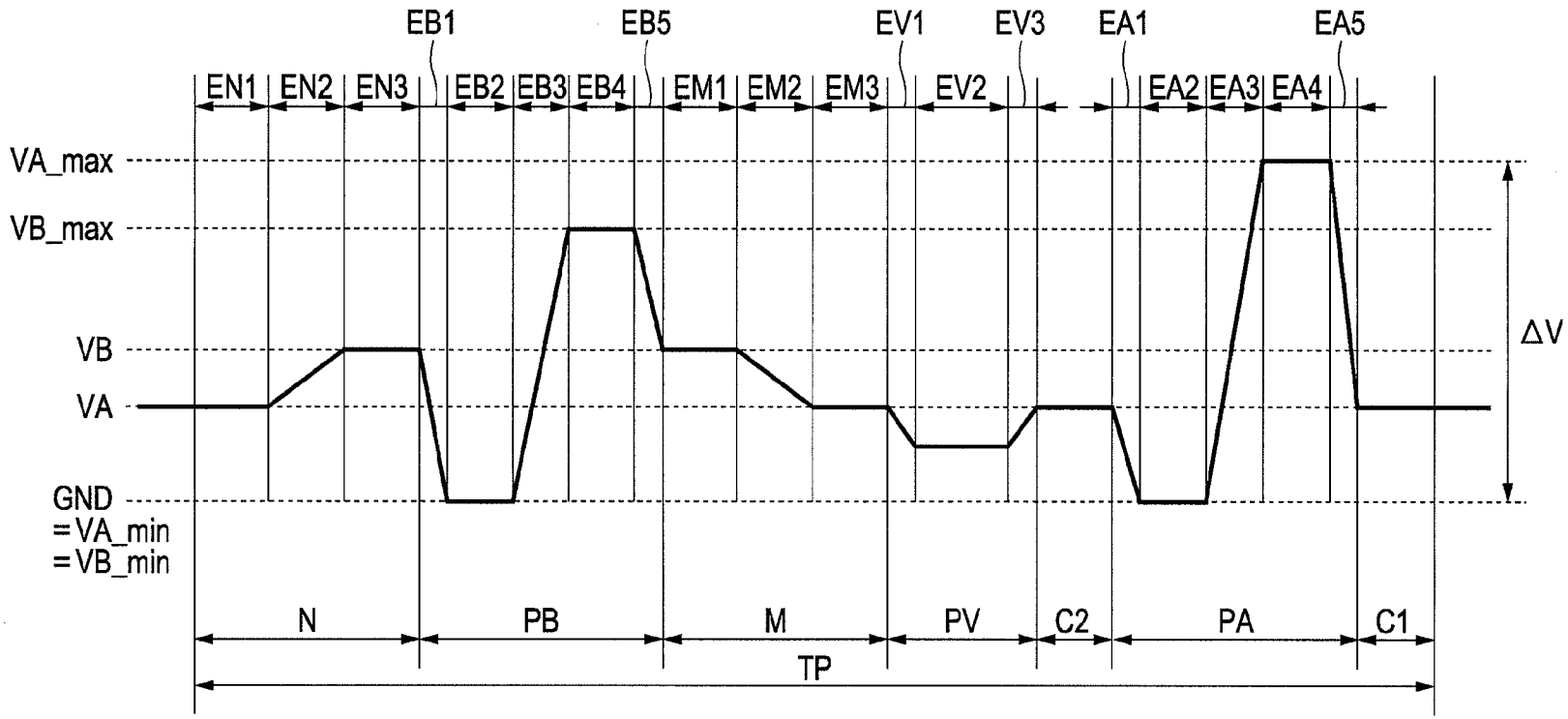
FIG. 12 is a wave form diagram of the driving signal in a modified example of the fourth embodiment.

In addition, in FIG. 11, the driving signal COM was described as an example which is set to the reference electric potential VB in the time point and the terminal point of the printing cycle TP. However, it is also possible to adopt a driving signal COM of FIG. 12 which is set to the reference electric potential VA in the time point and the terminal point of the printing cycle TP. In the driving signal COM of FIG. 12, the ejection pulse PB is placed ahead of the ejection pulse PA, the first transition element M is placed immediately after the ejection pulse PB, and the second transition element N is placed immediately before the ejection pulse PB. Like the third embodiment, the first transition element M (the variation element EM2) is an element in which the electric potential is changed from the reference electric potential VB to the reference electric potential VA, and the second transition element N (the variation element EN2) is an element in which the electric potential is changed from the reference electric potential VA to the reference electric potential VB. The starting end and the terminal end of the minute vibration pulse PV are set to the reference electric potential VA, and the front connection element C2 and the rear connection element C1 of the ejection pulse PA maintain the reference electric potential VA. That is, the driving signal COM of FIG. 12 is set to the reference electric potential VA in the time point (the starting end of the second transition element N) and the terminal point (the terminal end of the connection element C1) of the printing cycle TP. In the configuration using the driving signal COM of FIG. 12, when selecting the ejection pulse PB (DC="11" and "01"), the piezoelectric element 45 is supplied with the variation element EM2 of the first transition element M and the variation element EN2 of the second transition element N together with the ejection pulse PB.

In addition, the configuration of the second embodiment, which forms the minute vibration pulse PV in the first transition element M and the second transition element N, is also similarly applied to a configuration in which the minute vibration pulse PV is omitted from the driving signal COM shown in FIGS. 10 to 12. That is, it is possible to cause the piezoelectric element 45 to execute the minute vibration driving, by supplying (supplying the trapezoidal minute vibration pulse PV having both ends in the variation element EM2 and the variation element EN2) the piezoelectric element 45 with the first transition element M (the variation element EM2) and the second transition element N (the variation element EN2) of the driving signal COM in which the minute vibration pulse PV of FIGS. 10 to 12 is omitted.

E: Modified Example

The respective embodiments mentioned above are variously modified. Forms of specific modifications will be described as below. Two or more forms arbitrarily selected from examples below can suitably be merged.

1. Modified Example 1

Figure 13:
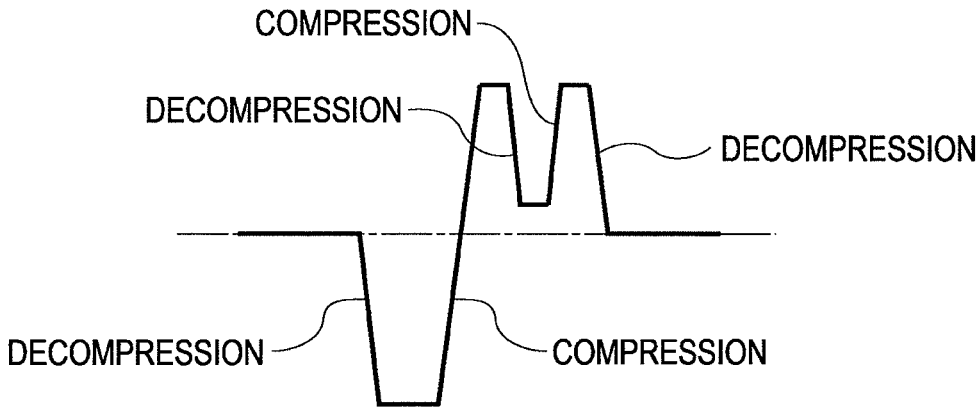
FIG. 13 is a wave form diagram of an ejection pulse in a modified example.
Figure 14:
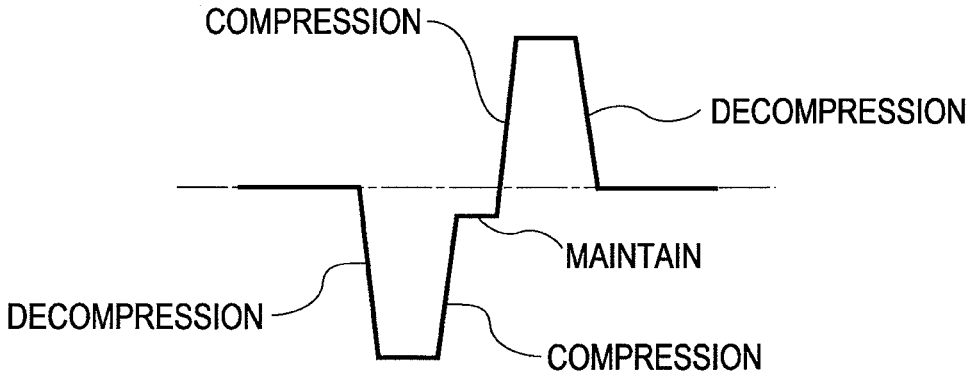
FIG. 14 is a wave form diagram of an ejection pulse in a modified example.
Figure 15:
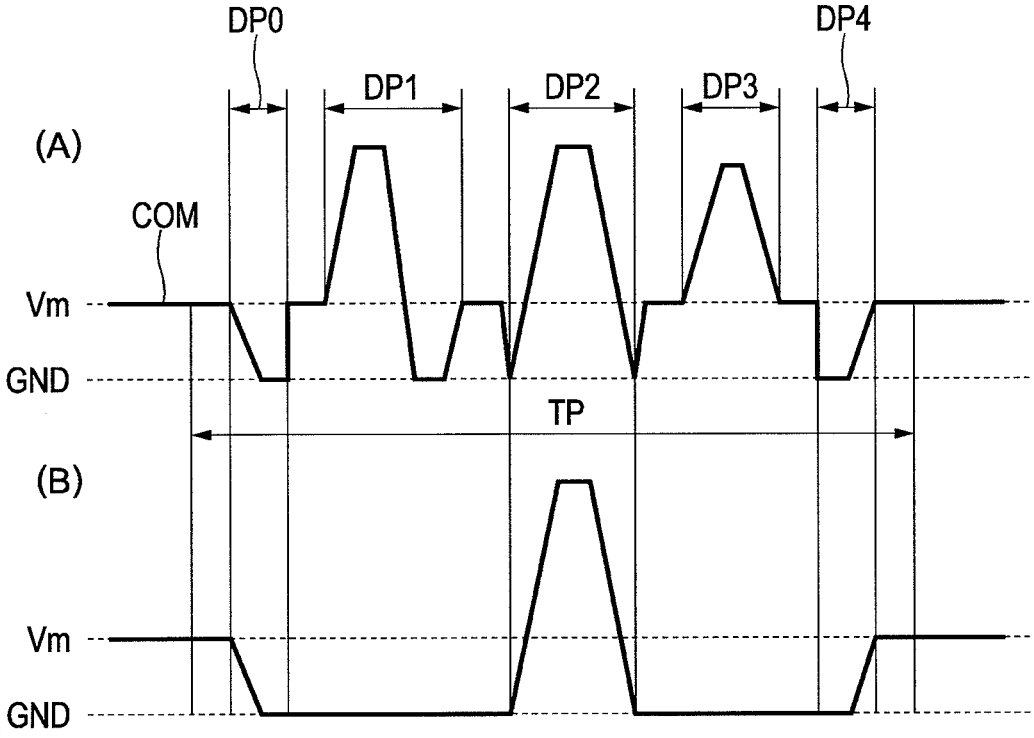
FIG. 15 is a wave form diagram of a driving signal of JP-A-2003-251807.

The wave form of the driving signal COM is arbitrary, and the total number and the wave form of each pulse (the ejection pulse, and the minute vibration pulse) in the printing cycle TP are suitably changed. For example, it is also possible to use a wave form in which the pressure of ink in the pressure chamber 50 is varied in the sequence of decompression→compression→decompression→compression→decompression, as shown in FIG. 13, and a wave form in which a course of pressing with a section keeping the electric potential therebetween is divided into two steps, as shown in FIG. 14, as the ejection pulse PA and the ejection pulse PB. The wave forms of the ejection pulse PA and the ejection pulse PB described in the respective embodiments mentioned above and the wave form shown in FIGS. 13 and 14 are included as a decompression element decompressing ink in the pressure chamber 50, a compression element compressing ink in the pressure chamber 50 after the decompression by the decompression element, and a decompression element decompressing ink in the pressure chamber 50 after the compression by the compression element. Of course, like the ejection pulse DP2 of FIG. 15, the wave form decompressing ink after the compression of ink in the pressure chamber 50 can also be used as the ejection pulse PA and the ejection pulse PB.

Furthermore, although the driving signal COM of one system was supplied to the recording head 24 in the respective embodiment mentioned above, it is also possible to adopt a configuration in which the driving signals of multi-systems are used for driving the respective piezoelectric elements 45 (for example, a configuration in which the ejection pulse and the minute vibration pulse are placed in the driving signals of the different systems). In addition, a relationship between high and low of the electric potential to be supplied to the piezoelectric element 45 and a direction of the displacement of the piezoelectric element 45 is arbitrary. That is, on the contrary to the respective embodiments in which ink in the pressure chamber 50 is compressed when the electric potential (the driving signal COM) to be supplied to the piezoelectric element 45 rises, a configuration is also adopted in which the piezoelectric element 45 is displaced so that ink in the pressure chamber 50 is decompressed when the electric potential to be supplied to the piezoelectric element 45 rises.

2. Modified Example 2

In the respective embodiments mentioned above, a serial type printing apparatus 100 was described as an example which moves the carriage 12 mounted with the recording head 24, but the invention is also able to be applied to a line type printing apparatus 100 in which a plurality of nozzles 52 is arranged so as to face the whole areas of the recording paper 200 in the width direction. In the line type printing apparatus 100, the recording head 24 is fixed, and an image is recorded on the recording paper 200 by ejecting the ink droplets of ink from the respective nozzles 52 while transporting the recording paper 200. As will be described the description mentioned above, the mobile/fixing of the recording head 24 itself is irrespective in the invention.

3. Modified Example 3

The configuration of the element (the pressure generating element) changing the pressure of ink in the pressure chamber 50 is not limited to the examples mentioned above. For example, it is also possible to use a vibrator such as an electromagnetic actuator. Furthermore, the pressure generating element of the invention is not limited to an element that applies a mechanical vibration to the pressure chamber 50. For example, it is also possible to use a heating element (a heater), which generates air bubbles by the heating of the pressure chamber 50 to change the pressure of ink in the pressure chamber 50, as the pressure generating element. That is, the pressure generating element of the invention is included as an element that changes the pressure of ink in the pressure chamber 50, and a method (a piezoelectric method/a thermal method) of changing the pressure and a configuration thereof are irrespective.

4. Modified Example 4

The printing apparatuses 100 of the respective embodiments mentioned above are able to be adopted to various devices such as a plotter, a facsimile machine, and a copier. Of course, the application of the liquid ejecting apparatus of the invention is not limited to the printing of an image. For example, the liquid ejecting apparatus ejecting solution each color material is used as a manufacturing apparatus that forms a color filter of a liquid crystal display apparatus. Furthermore, the liquid ejecting apparatus ejecting a liquid-shaped conductive material is used as, for example, an electrode manufacturing apparatus that forms an electrode of the display apparatus such as an organic EL (Electroluminescence) display apparatus and an electric field emission display apparatus (FED: Field Emission Display). Furthermore, a liquid ejecting apparatus ejecting solution of a living body organic matter is used as a chip manufacturing apparatus which manufactures a biochemical element (a biochip). Moreover, objects (landing targets) becoming a target of the ejection of liquid are different from the application of the liquid ejecting apparatus. For example, the landing target of the printing apparatus 100 mentioned above is the recording paper 200, but when the liquid ejecting apparatus is used for manufacturing the display apparatus, for example, a substrate constituting the display apparatus corresponds to the landing target.

The entire disclosure of Japanese Patent Application No. 2011-036812, filed Feb. 23, 2011 is expressly incorporated by reference herein.

What is claimed is:

1. A liquid ejecting apparatus comprising:

nozzles which eject liquid;

a pressure chamber which communicates with the nozzles;

a pressure generating element which changes the pressure of liquid in the pressure chamber and ejects the liquid from the nozzles;

a driving signal generating unit that generates a driving signal including a first ejection wave form and a second ejection wave form which causes the liquid to be ejected to the pressure generating element, and a first transition element between the first ejection wave form and the second ejection wave form; and a driving unit which controls the supplying of the driving signal to the pressure generating element, wherein each of the first ejection wave form and the second ejection wave form includes a decompression element that causes the liquid to be decompressed in the pressure chamber, a compression element that causes the liquid to be compressed in the pressure chamber after the decompression by the decompression element, and a decompression element that causes the liquid to be decompressed in the pressure chamber after the compression by the compression element, the first ejection wave form is set to a first reference electric potential at a starting end and a terminal end, the second ejection wave form is set to a second reference electric potential at the starting end and the terminal end, an electric potential difference between the first reference electric potential and a lowest electric potential of the first ejection wave form is smaller than an electric potential difference between the second reference electric potential and a lowest electric potential of the second ejection wave form, the first reference electric potential is lower than the second reference electric potential, and an electric potential of the first transition element is changed from one of the first reference electric potential and the second reference electric potential to the other thereof.

2. The liquid ejecting apparatus according to claim 1, wherein the first reference electric potential and the second reference electric potential are set such that the lowest electric potential of the first ejection wave form is equal to the lowest electric potential of the second ejection wave form.

3. The liquid ejecting apparatus according to claim 2, wherein the first reference electric potential and the second reference electric potential are set such that the lowest electric potential of the first ejection wave form and the lowest electric potential of the second ejection wave form become a ground electric potential.

4. The liquid ejecting apparatus according to claim 3, wherein, the lower supplying of an electric potential to the piezoelectric element is, the greater a pressure variation amount of the pressure chamber of the case of changing supplying of an electric potential to the pressure generating element by a predetermined amount is.

5. The liquid ejecting apparatus according to claim 1, wherein an electric potential difference between a highest electric potential and a lowest electric potential of the first ejection wave form and the second ejection wave form in the driving signal is lower than an electric potential difference between a highest electric potential and a lowest electric potential of the first ejection wave form and the second ejection wave form when setting the first reference electric potential and the second reference electric potential to be equal to each other.

6. The liquid ejecting apparatus according to claim 1, wherein the driving unit is able to select both of the first ejection wave form and the second ejection wave form and supply the same to the pressure generating element.

7. The liquid ejecting apparatus according to claim 1, wherein the first ejection wave form is situated ahead of the second ejection wave form, the first transition element is a section in which the electric potential is changed from the first reference electric potential to the second reference electric potential, and the driving signal includes a second transition element that is placed behind the second ejection wave form and in which the electric potential is changed from the second reference electric potential to the first reference electric potential.

8. The liquid ejecting apparatus according to claim 1, wherein the first ejection wave form is situated ahead of the second ejection wave form, the first transition element is a section in which the electric potential is changed from the first reference electric potential to the second reference electric potential, and the driving signal includes a second transition element which is placed ahead of the first ejection wave form and in which the electric potential is changed from the second reference electric potential to the first reference electric potential.

9. The liquid ejecting apparatus according to claim 1, wherein the first ejection wave form is situated behind the second ejection wave form, the first transition element is a section in which the electric potential is changed from the second reference electric potential to the first reference electric potential, and the driving signal includes a second transition element that is placed behind the first ejection wave form and in which the electric potential is changed from the first reference electric potential to the second reference electric potential.

10. The liquid ejecting apparatus according to claim 1, wherein the first ejection wave form is situated behind the second ejection wave form, the first transition element is a section in which the electric potential is changed from the second reference electric potential to the first reference electric potential, and the driving signal includes a second transition element that is placed ahead of the second ejection wave form and in which the electric potential is changed from the first reference electric potential to the second reference electric potential.

11. The liquid ejecting apparatus according to claim 7, wherein the driving unit minutely vibrates liquid surfaces in the nozzles so that liquid is not ejected from the nozzles by supplying the first transition element and the second transition element to the pressure generating element.

12. A method of controlling the liquid ejecting apparatus that includes nozzles ejecting liquid, a pressure chamber communicating with the nozzles, and a pressure generating element which changes a pressure in the pressure chamber and ejects the liquid from the nozzles, the method comprising:

generating a driving signal that includes a first ejection wave form and a second ejection wave form which causes the liquid to be ejected to the pressure generating element, and a first transition element between the first ejection wave form and the second ejection wave form; and controlling the supplying of the driving signal to the pressure generating element, wherein the first ejection wave form is set to a first reference electric potential at a starting end and a terminal end, the second ejection wave form is set to a second reference electric potential at the starting end and the terminal end, an electric potential difference between the first reference electric potential and a lowest electric potential of the first ejection wave form is smaller than an electric potential difference between the second reference electric potential and a lowest electric potential of the second ejection wave form, the first reference electric potential is lower than the second reference electric potential, and the electric potential of the first transition element is changed from one of the first reference electric potential and the second reference electric potential to the other thereof.

* * * * *